United States Patent [19]

Rudick

[11] Patent Number: 4,898,308

[45] Date of Patent: Feb. 6, 1990

[54] REMOVABLE SYRUP PACKAGE

[75] Inventor: Arthur G. Rudick, Marietta, Ga.

[73] Assignee: The Coca-Cola Company, Atlanta, Ga.

[21] Appl. No.: 233,133

[22] Filed: Aug. 17, 1988

[51] Int. Cl.[4] ..... B65D 88/34

[52] U.S. Cl. ..... 222/325; 222/481.5; 222/482; 222/498; 222/504; 222/505; 222/517; 222/556; 222/562

[58] Field of Search ..... 222/185, 325, 481.5, 222/482, 483, 484, 498, 504, 508, 517, 505, 506, 556, 562

[56] References Cited

U.S. PATENT DOCUMENTS

| | | | |
|---|---|---|---|
| 2,325,441 | 7/1943 | Tucker et al. | 222/504 |
| 3,042,267 | 7/1962 | Reynard | 222/517 X |
| 3,059,816 | 10/1962 | Goldstein | 222/484 |
| 3,913,611 | 10/1975 | St John | 222/479 X |
| 4,269,333 | 5/1981 | Nakai et al. | 222/484 |
| 4,660,742 | 4/1987 | Ozdemir | 222/504 X |
| 4,717,050 | 1/1988 | Wright | 222/482 |
| 4,773,561 | 9/1988 | Sedam | 222/325 X |
| 4,804,117 | 2/1989 | Rudick | 222/522 X |

*Primary Examiner*—Joseph J. Rolla
*Assistant Examiner*—Gregory L. Huson
*Attorney, Agent, or Firm*—Birch, Stewart, Kolasch & Birch

[57] ABSTRACT

A removable package for dispensing syrup in a post-mix soft drink dispensing system and having an actuated closure mechanism. The package includes an upper body portion from which a lower discharge portion extends outwardly therefrom and which further includes an outwardly facing discharge port. The closure assembly includes a movable outer cap member pivotally attached to a facing member. The facing member fits over the discharge port and includes a syrup outlet opening and an air inlet opening therein. The cap member includes means for closing off both openings when in contact with the facing member. An actuator including a spring biased roller contacts the cap member such that when a dispensing operation is required, the cap member is swung outward by means of the roller away from the facing member, exposing the syrup outlet and air inlet openings. When the dispensing operation is completed, the roller forces the cap member back into contact with the facing member to reseal the openings.

20 Claims, 1 Drawing Sheet

REMOVABLE SYRUP PACKAGE

BACKGROUND OF THE INVENTION

This invention relates generally to containers for dispensing liquids and more particularly to a removable and disposable package and an actuated closure cap assembly therefor for use in a post-mix soft drink type beverage dispensing system.

Post-mix beverage dispensing apparatus is generally known, with the more common form of such apparatus being the commercially available post-mix beverage dispenser units which have been designed for large volume commercial uses such as used in fast food restaurants. More recently, however, attempts have been made in the industry to reduce the cost, size and weight of such beverage dispensing units to make them available to the general public for private use.

Such apparatus, moreover, typically include a removably disposable package for dispensing liquids such as a syrup mixture which is then mixed with carbonated water at mixing head located adjacent the dispensing outlet. For such systems to be acceptable to the consuming public, supplies of these ingredients must be capable of being quickly and easily replenished by a user who may be relatively unskilled. In addition, the syrup component must be made available, for example at supermarkets in the form of a quickly and easily replaceable disposable package. An example of a disposable syrup package which may be used in a small post-mix beverage dispensing system is disclosed in U.S. Pat. No. 4,216,885 which issued to J.K. Sedam, on Aug. 12, 1980. This patent is assigned to the assignee of the present invention.

SUMMARY OF THE INVENTION

Accordingly, it is an object of the present invention to provide an improvement in post-mix beverage dispensing systems.

It is a further object of the invention to provide an improvement in a removable container for dispensing a liquid in a post-mix beverage dispensing system.

It is yet a further object of the invention to provide an improvement in closure means utilized in connection with a removable package utilized in connection with a post-mix beverage dispensing system.

And it is yet another object of the invention to provide a removable and disposable package and closure therefor that is simple in construction, economical to produce and reliable in operation so that it can be incorporated in a relatively maintenance free beverage dispensing system.

Briefly, the foregoing and other objects are accomplished by a removable and disposable package type of container for dispensing a liquid, such as syrup, and an actuated closure mechanism therefor, which in its broadest aspect, comprises an upper body portion from which a lower discharge portion extends outwardly therefrom and which includes a generally horizontal discharge opening or port projecting therefrom. The closure assembly is comprised of a movable outer cap member pivotally attached to a facing member. The facing member fits over the discharge port and includes a syrup outlet opening and an air inlet opening therein. The cap member includes means for closing off both openings when in contact with the facing member. An actuator contacts the cap member such that when a dispensing operation is required, the cap member is swung outwardly away from the facing member, exposing the syrup outlet and air inlet openings. When the dispensing operation is completed, the actuator urges the cap member back into contact with the facing member to reseal the openings.

DESCRIPTION OF THE DRAWINGS

Further objects and advantages and features of this invention will become apparent when the following specification is considered with the accompanying drawings wherein.

DESCRIPTION OF THE PREFERRED EMBODIMENT

Figure 1:
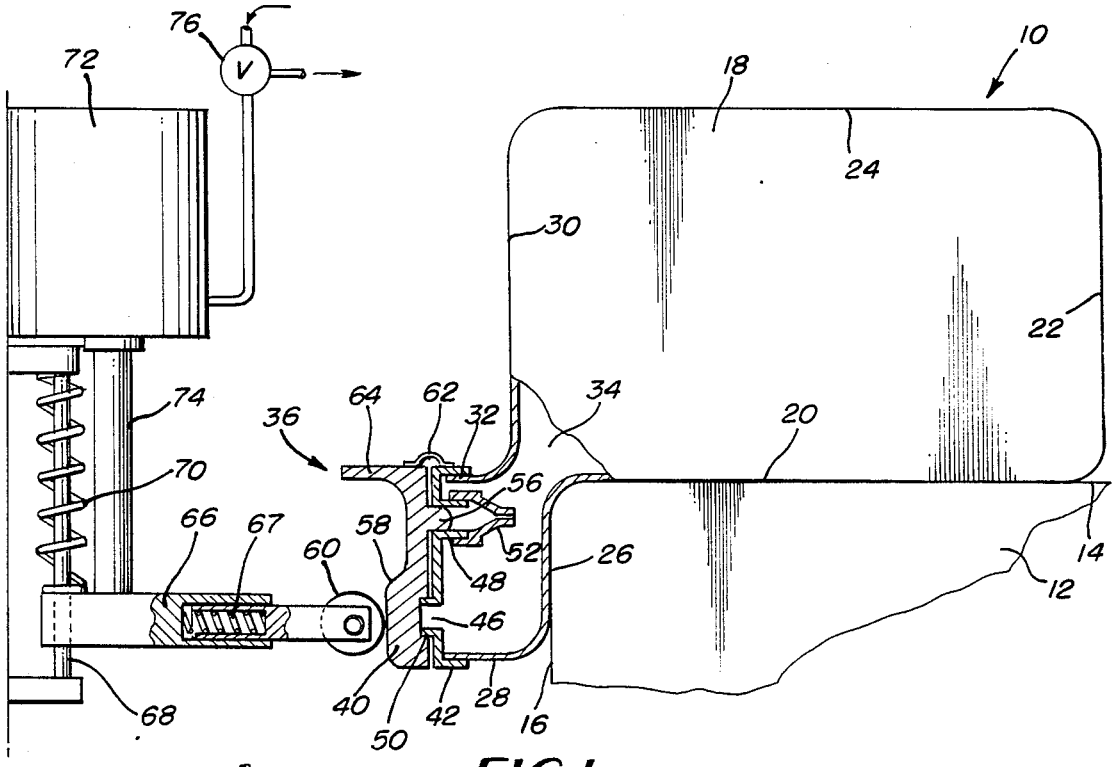
FIG. 1 is a mechanical schematic diagram, partially in section, of the preferred embodiment of the subject invention in a first or closed operating state.

Referring now to the drawings wherein like reference numerals refer to identical parts throughout, reference numeral 10, for example, denotes a removable syrup container in the form of a flexible package for use in a carbonated post-mix beverage dispenser. The dispenser, per se, is not shown except for a support member 12 shown having a generally horizontal support surface 14 and a generally vertical side surface 16.

Figure 2:
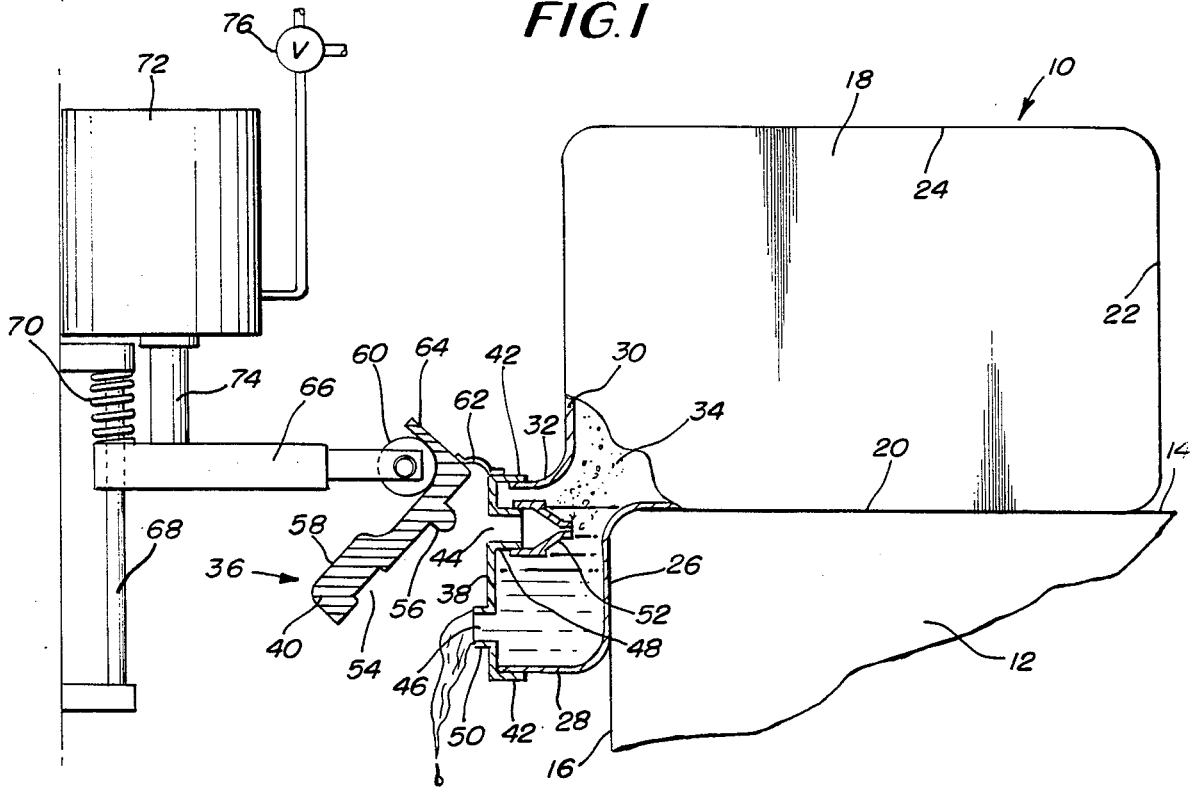
FIG. 2 is a schematic mechanical diagram of the apparatus shown in FIG. 1 in a second or open operating state.

As shown in both FIGS. 1 and 2, the package 10 includes a generally rectangularly shaped upper body portion 18 which functions as a liquid reservoir for syrup or the like and includes an elongated bottom wall 20. When the package is installed in a dispenser, the bottom wall 20 rests on the surface 14 of the dispenser member 12. The bottom wall 20 terminates in a rear wall 22 which extends upwardly to a top wall 24. The forward portion of the bottom wall 20 terminates in a discharge portion which includes a downwardly extending front wall portion 26 having a generally horizontal end section 28. The body portion 18 additionally includes a front wall 30 which extends downwardly from the top wall 24 where it terminates in a generally horizontal end section 32 which is separated from the wall section 28 and forms the top part of the discharge portion. A relatively small channel region 34 is provided between the bottom and front walls 20 and 30 for passage of liquid downwardly therethrough.

A mechanically actuated closure assembly 36 is fitted over the lower outlet portion of the housing 18 as defined by the wall portions 28 and 32 as well as a pair of opposing corresponding side wall portions, not shown, so as to form a four sided discharge port. The closure assembly 36 is comprised of a stationary facing member 38 and a movable cap member 40 which is hingedly attached at its upper extremity thereto. The facing member 38 includes flange sections 42 which when fitted to the body portions 18, engage the wall sections 28 and 32 as shown and the corresponding side wall sections, not shown. The facing member additionally includes an upper air inlet opening 44 and a lower liquid outlet opening 46. The air inlet opening 44 is formed by inwardly projecting wall members 48 while the liquid outlet opening 46 is formed by outwardly projecting wall member 50. The openings 44 and 46 are configured as generally circular openings; however, it should be noted that when desirable rectangular openings could just as easily be formed.

Additionally, an air check valve device 52 is attached to the inwardly projecting wall portions 48 of the air inlet 44 to permit continuous liquid flow from the outlet 46 when the cap member 40 is opened. The check valve device 52 can be of a "duck bill" type valve and functions to prevent any liquid from flowing out of the air inlet 44 at the very beginning of a liquid dispensing operation from the package 10. However, any suitable type of check valve can be used. When desirable, however, this device can be eliminated in certain circumstances where a small amount of outflow from the air inlet 44 might be tolerated.

The construction of the cap member 40 includes an inner recess 54 for fitting over the outwardly projecting wall portions 50 of the liquid outlet 46 and an outwardly projecting tip 56 which fits into the air inlet 44 in the closed position. The outer surface 58 of the cap member 40 comprises a cam type surface which engages a spring biased roller 60 of an actuating mechanism for opening and closing the cap member over the facing member 38. A resilient hinge member 62 spans the upper flange 42 of the facing member 38 and an upper shoulder portion 64 of the cap member 40; however, any type of pivot element can be utilized.

The roller 60 is further shown in FIGS. 1 and 2 connected to an arm 66 which includes a roller bias spring 67 and which slides vertically on a guide rod 68 which includes a compression spring 70 located thereon. The compression spring 70 biases the roller downwardly against the raised portion of the outer cap surface 58 which causes the cap member 40 to close against the facing member 38 and thus obstruct both the liquid outlet opening 46 and the air inlet opening 44. This constitutes the closed operating state of the apparatus.

An open operating state is effected when a liquid, e.g. syrup dispensing operation is required. At such time, the roller 60 is urged upwardly into the depressed portion of cam surface 58 of the cap surface 40 where it abuts the shoulder portion 64 thereof. This causes the cap member 40 to pivot and swing outwardly and thus expose the air inlet opening 42 and the liquid outlet opening 46. This operation is provided in the embodiment shown by a pneumatic cylinder 72 coupled to the arm 66 by means of a piston rod 74 which retracts when air pressure is fed into the lower part of the pneumatic cylinder 72 by means of a three way valve 76 which in one position feeds air pressure from a source, not shown, to the pneumatic cylinder, while in its other position against the air pressure within the cylinder to the outside atmosphere, whereupon the spring 70 urges the roller 60 back into the closed position of the apparatus as shown in FIG. 1.

Thus what has been shown and described is a removable liquid package for acting as a syrup reservoir for a post-mix beverage dispensing system and which additionally includes a relatively simple yet effective hinged closure cap assembly. The assembly is actuated by a spring loaded roller member which operates to pivotally open and close the cap member against a stationary facing which includes an air inlet opening and a fluid outlet opening.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

I claim:

1. Apparatus for a beverage dispensing system comprising:

a removable package containing liquid to be dispensed and including a body portion and a liquid discharge portion having a discharge port therein from which said liquid may be dispensed;

an actuated closure assembly including a stationary facing member disposed over said discharge port and having an air inlet opening and a liquid outlet opening therein, and a cap member pivotally attached to said facing member and having means for closing off said air inlet opening and said liquid outlet opening when in contact therewith during a closed operating state and exposing said openings when said cap member is pivoted away from said facing member during an open operating state; and actuator means for pivoting said cap member between said closed and open operating state, said actuator means comprising a movably driven member in contact with said cap member and being movable between a first and a second position to effect said closed and open operating state.

2. The apparatus as defined by claim 1 wherein air inlet opening of said facing member is located above said liquid outlet opening.

3. The apparatus as defined by claim 2 and further comprising check valve means coupled to said air inlet opening of said facing member interiorally of said discharge port for permitting air to flow into the interior of said package during said open operating state to permit free flow of liquid from said liquid outlet opening and to prevent liquid from flowing out of the air inlet opening.

4. The apparatus as defined by claim 3 wherein said check valve means comprises a duck bill type of air check valve.

5. The apparatus as defined by claim 1 wherein said body portion comprises an upper, relatively large body portion and wherein said liquid discharge portion comprises a lower, relatively smaller discharge portion extending outwardly and downwardly from said body portion and wherein said discharge port comprises an outwardly facing port in said discharge portion.

6. The apparatus as defined by claim 5 wherein said upper body portion of said package is generally rectangular in cross section and having at least one generally flat side wall for contact with an external support surface of the dispensing system.

7. The apparatus as defined by claim 5 wherein said upper body portion is comprised of relatively longer top, bottom and side walls and relatively shorter front and rear walls and wherein said discharge portion is located adjacent the lower portion of said front wall and the forward portion of said bottom wall.

8. The apparatus as defined by claim 7 wherein said top, bottom and side walls are comprised of generally flat walls.

9. The apparatus as defined by claim 7 wherein said discharge portion comprises extensions of said forward, bottom and side walls.

10. The apparatus as defined by claim 9 wherein said discharge portion is comprised of angulated extensions of said forward and bottom walls of said body portion.

11. The apparatus as defined by claim 10 wherein said discharge port is defined by the terminal ends of said extensions of said forward, bottom and side walls.

12. The apparatus as defined by claim 1 wherein said movably driven member comprises a cam follower member.

13. The apparatus as defined by claim 12 wherein said cam follower member comprises a roller member.

14. The apparatus as defined by claim 12 wherein said cap member includes a camming outer surface in contact with said cam follower member.

15. The apparatus as defined by claim 14 wherein said camming surface includes a raised cam surface adjacent said liquid outlet opening of said facing member and a depressed cam surface adjacent said air inlet opening of said facing member and wherein said cap member additionally includes a shoulder member at one end thereof adjacent said depressed cam surface whereby said cam follower member contacts said depressed cam surface and said shoulder member during said open operating state.

16. The apparatus as defined by claim 15 wherein said air inlet opening comprises a female type opening and said outlet opening comprises a male type opening and wherein said means of said cap member for closing off said air inlet opening comprises an outwardly projecting element formed on the inside surface of said cap member adjacent said depressed cam surface and wherein said means for closing off said liquid outlet opening comprises a recess formed on the inner surface of said cap member adjacent said raised cam surface.

17. The apparatus as defined by claim 15 and wherein said roller member comprises a spring-biased roller member biased to position said roller member against the raised cam surface of said cap member during said closed operating state.

18. The apparatus as defined by claim 17 wherein said actuator means additionally includes means for moving said spring-biased roller member from said raised cam surface to said depressed cam surface and said shoulder element of said cap member during said open operating state.

19. The apparatus as defined by claim 18 wherein said roller member is actuated by a pneumatic cylinder having a piston rod coupled to said roller member.

20. The apparatus as defined by claim 19 wherein said piston rod is connected to an arm member having one end attached to a guide rod on which is mounted a compression spring member for biasing said roller and having the other end attached to said roller member.

* * * * *